United States Patent [19]

Fetter et al.

[11] Patent Number: 5,074,172

[45] Date of Patent: Dec. 24, 1991

[54] SPARK PLUG SOCKET WRENCH

[76] Inventors: Jack E. Fetter, 730 SE. Rene Ave., Gresham, Oreg. 97080; Bert J. Fetter, 54040 NE. 121st Ave., Vancouver, Wash. 98682

[21] Appl. No.: 617,962

[22] Filed: Nov. 19, 1990

Related U.S. Application Data

[63] Continuation of Ser. No. 443,803, Nov. 28, 1989, abandoned, which is a continuation of Ser. No. 297,975, Jan. 17, 1989, abandoned, which is a continuation of Ser. No. 73,071, Jul. 13, 1987, abandoned.

[51] Int. Cl.[5] ..... B25B 13/06

[52] U.S. Cl. ..... 81/125; 81/124.3

[58] Field of Search ..... 81/64, 125, 124.3

[56] References Cited

U.S. PATENT DOCUMENTS

| | | | |
|---|---|---|---|
| 3,869,945 | 3/1975 | Zerver | 81/125 |
| 4,060,113 | 11/1977 | Matsushima | 81/125 |
| 4,578,835 | 4/1986 | Pichler et al. | 7/168 |
| 4,818,157 | 4/1989 | Kouvelis | 81/125 X |

FOREIGN PATENT DOCUMENTS

| | | | |
|---|---|---|---|
| 3226134 | 1/1984 | Fed. Rep. of Germany | 81/125 |

*Primary Examiner*—D. S. Meislin

*Attorney, Agent, or Firm*—Eugene M. Eckelman

[57] ABSTRACT

A tubular body member has an interior hexagon socket end arranged to freely receive the hexagon end base of a spark plug. An elongated groove is provided in the hexagon socket end which receives a leaf spring secured at one of its ends and arranged to engage a portion of the hexagon base of a spark plug for releasably holding the spark plug in the wrench. The tubular body member also has a body portion of reduced diameter relative to the hexagon socket end, such reduced diameter portion allowing the wrench to be worked in tight places. The interior of the reduced diameter tubular body member is of sufficient size to receive a spark plug insulator portion with clearance therearound, and this reduced portion and the socket end of the wrench are dimensioned and arranged whereby an interior juncture therebetween is adjacent the locking collar of a spark plug which is mounted in the wrench, whereby lateral movement of the wrench relative to a spark plug can only produce forces against the spark plug against the locking collar. The tubular body member has a square opening at its end opposite from the hexagon socket end arranged for engagement by a ratchet drive mechanism. The leaf spring is secured in the groove by upset metal portions of the groove.

2 Claims, 2 Drawing Sheets

FIG. 1
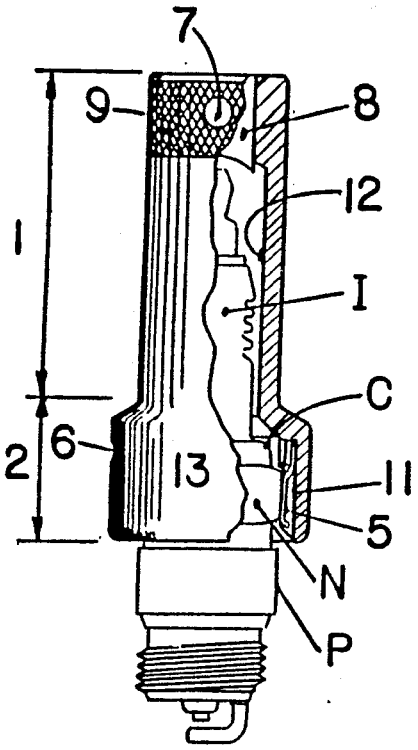
FIG. 4
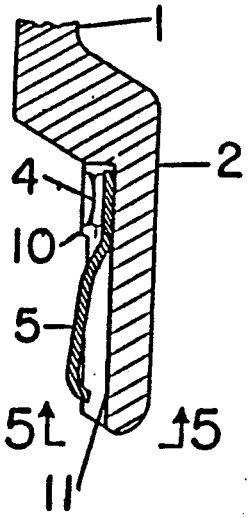
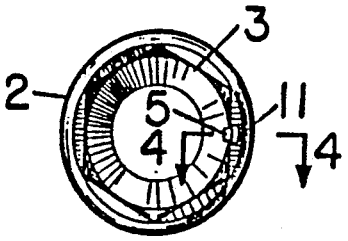
FIG. 2
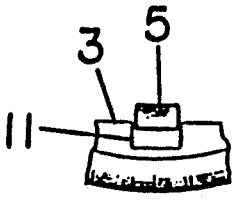
FIG. 5
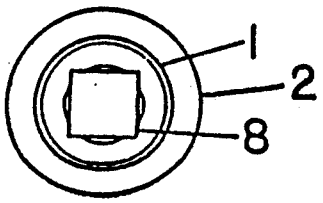
FIG. 3
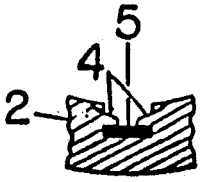
FIG. 6

SPARK PLUG SOCKET WRENCH

This application is a continuation of application Ser. No. 07/443,803, filed 11/28/89 abandoned which is a continuation of 07/297,975 filed Jan. 17, 1989 abandoned which is a continuation of 07/073,071 filed July 13, 1987 abandoned.

BACKGROUND OF THE INVENTION

This invention relates to new and useful improvements in spark plug socket wrenches.

For many years there has been a real need for a much more effective tool to perform the routine maintenance job of changing spark plugs, especially in recent years the modern engine compartments have become cluttered with electronics, wires, hoses and peripheral equipment causing spark plugs to be extremely difficult to work on.

The tool available to mechanics through the years, known as a "spark plug socket", is nothing more than a deep socket wrench having a rubber or plastic grommet inside, used as a spark plug gripping device, where the non-metallic terminal end insulator of the spark plug is forced into the grommet, as the means of holding a spark plug in the socket of the wrench. The terminal end insulator is not the same for all spark plugs, causing several problems for mechanics.

This so-called spark plug socket has at times seemed to cause more problems than it solved, but has been the only tool available, that has a chance to hold a spark plug in the socket long enough to lift the plug out of, or lower it into an engine compartment safely. More often the spark plugs fall from the socket to be wedged among engine equipment, or to clatter across the floor, in either case wasting valuable time. The old sockets are awkward to use, their large size making it necessary to remove; then reinstall peripheral engine equipment, just to change a spark plug. Also this wastes more valuable time and risks damage to the equipment being removed and replaced.

Over the years mechanics have developed "tricks of the trade", or found gimmicks to help get the job done. At times these gimmicks cause frustration, always costing time, but they help get the job done. Once in awhile a mechanic will buy another "spark plug socket" trying to find one that will do the job better, only to have the same problems.

Accordingly, an objective of our invention is to provide an improved spark plug socket wrench that will securely and consistently hold any spark plug in the socket without fear of it falling out, until the mechanic wants it to come out.

Another objective of our invention is to provide an improved socket wrench that prevents cracking or breaking the non-metallic terminal end insulator.

Another objective of our invention is to provide an improved socket wrench small enough to be maneuvered between peripheral equipment, thereby minimizing the need to remove and replace unrelated equipment, saving time for the mechanics.

Another and the primary objective of our invention is to provide an improved socket wrench made in the U.S.A., that will perform the mechanical process of removing, inserting and applying torque more efficiently and effectively than any tool made anywhere in the world.

Our invention, an Improved Spark Plug Socket Wrench, described in the Description and specification, accomplishes all of these objectives and more.

SUMMARY OF THE INVENTION

Briefly, these and other objectives are achieved in accordance with our invention by a unique spark plug socket wrench, a vast improvement over the spark plug socket wrench that has been in general use for many years, only because there has been nothing else available. Our unique invention uses a means of holding a spark plug securely in the socket, thereby eliminating the danger of the spark plug inadvertently falling out of the socket, and preventing the terminal end insulator from being cracked or broken while in the socket. The invention also provides a streamlined, more versatile spark plug socket wrench for the mechanic one that can be easily used in more of the obstructed spaces found around spark plugs in modern engines, thereby greatly decreasing the need to remove and replace peripheral equipment when changing spark plugs.

BRIEF DESCRIPTION OF THE DRAWING

The subject matter which we regard as our invention is particularly pointed out in the Detailed Description and Specification, and distinctly claimed in the Claims. The structure and operation of our invention, together with further objects and advantages, may be better understood from the following description given in connection with the accompanying drawing, in which:

FIG. 1 is a side view of our tool, partly in cross section, a spark plug being engaged within the wrench.

FIG. 2 is a bottom view of FIG. 1, the spark plug not being shown;

FIG. 3 is a top view of FIG. 1 and shows in particular the square drive end used for a removable wrench.

FIG. 4 is an enlarged cross section of the immediate area around the spring and the spring.

FIG. 5 is a bottom end view of enlarged FIG. 4.

FIG. 6 is an enlarged longitudinal cross section at the position the spring is fastened:

DETAILED DESCRIPTION AND SPECIFICATION

Figure 7:
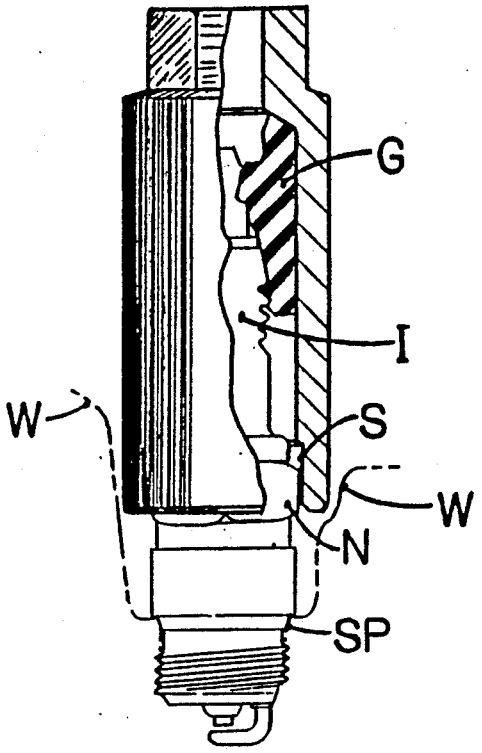
FIG. 7 is a side view, partly in cross section, of the grommet type spark plug socket wrench in general use today.

Our invention, an Improved Spark Plug Socket Wrench, is a new mechanical system developed to perform an improved mechanical process, used to remove, insert and torque spark plugs. This improved or alternate method of constructing the exact same mechanical system is necessary to reduce manufacturing costs. In the earlier patent application, when considering the spring gripping device we used for holding a spark plug in the socket, the job of forming the rectangular shaped holes use to fasten the spring in place, and the job of forming the spring are very expensive, thereby making it imperative to use an alternate shaped spring, and an alternate means of fastening, as shown and described herein, in order to sell our tools to the general public at an affordable price.

We have included a FIG. 7, on a separate sheet, which is a drawing showing an example of the spark plug socket wrench, that is now in general use throughout the world, to provide a more convenient comparison to our improvements, and to illustrate clearly the improved configuration and function of our new spark plug socket wrench.

The embodiment of our invention is shown in the accompanying drawing, where the mechanical process needed by mechanics when changing spark plugs, has dictated the following mechanical system which is embodied in our improved socket wrench. In general, our wrench comprises a tubular member having a body portion 1 and a base 2 with a hexagon socket open end 3, a spark plug stop 10 being disposed between the base and the socket end. When a spark plug nut N is pushed to rest against stop 10, spark plug nut N is engaged within the hexagon socket 3, the reactant force of a leaf spring 5 against nut N frictionally holding a spark plug in place. Spring 5 functions freely inside a longitudinal groove 11 located in one flat side of hexagon socket 3. Spring 5 is fastened at 4 in groove 11 by means of the metal at the edges of groove 11 being upset and forced over the innermost portion of spring 5. This is accomplished by means of a special tool used through round hole 6. The longitudinal interior 12 of the wrench body portion 1 is smaller in diameter than the socket 3 protectively guides non-metallic terminal end insulator I therein, whereby the juncture or shoulder 13 of interior 12 and socket 3 provides a means to minimize any force due to any lateral movement of insulator I, due to unstable torque, to be concentrated near the strongest point of insulator I, namely, that point adjacent to locking collar C which fastens insulator I to the metal hexagon nut 3 of the spark plug. The small diameter of interior 12 permits a smaller outside diameter for wrench body portion 1, this portion being considerably smaller than the outside diameter portion 2 of the wrench body but large enough to receive the spark plug insulator with clearance. The square hole 8 located at the top of body portion 1 is used for engaging a removable operating wrench (Not shown), the round hole 7 being a detent keeper for said removable operating wrench. An upper periphery of body portion 1 is knurled at 9.

A spark plug socket wrench has be in general use for many years, all are of a similar bulky design, and all of them continually have the same recurring problems.

When changing spark plugs the mechanic needs a tool capable of dependably retaining a spark plug inside the tool, until he wants to take it out, a tool capable of being maneuvered into restricted spaces, and with less chance of cracking the plugs insulator when torque is applied. Our improved socket wrench performs the job so well, the mechanic soon forgets these problems ever existed.

What we consider to be our invention is an improved spark plug socket wrench comprising a unique mechanical system, this improved mechanical system is created by the precise blend of all the shapes and parts comprising the entire socket wrench, whereby each part and shape being dependent on the other, the mechanical system is the combination of all the parts and shapes being organized in a specific sequence, whereby the parts and shapes are arranged in a categorical combination are determined by an improved mechanical process used to remove, insert and torque ignition spark plugs for all engines that require spark plugs. Our improved spark plug socket wrench provides the means to change spark plugs more efficiently and effectively than ever before possible.

We claim:

1. A spark plug wrench for installing and removing spark plugs of the type having a hexagon base and a reduced diameter insulator portion secured to the base by a metal locking collar at a juncture between the base and the insulator portion, comprising:

a tubular body member, said tubular body member having an interior hexagon socket end arranged to freely receive the hexagon base of a spark plug, a stop in said hexagon socket end engageable by the hexagon base of a spark plug for limiting insertion of a spark plug in the wrench, a longitudinal groove in said hexagon socket end, a leaf spring secured at one of its ends longitudinally in said groove arranged to engage a portion of the hexagon base of a spark plug for releasably holding the spark plug in the wrench, said tubular body member having a body portion of reduced outer and inner diameters relative to said hexagon socket end with the interior thereof being of an internal diameter only slightly larger than the outer diameter of a spark plug insulator portion, the interior of said body member comprising a free space and arranged to freely receive the entire spark plug insulator portion, said hexagon socket end and said reduced diameter tubular portion forming an interiorly projecting shoulder therebetween which is adjacent said stop and the locking collar of a spark plug mounted in the wrench, said stop in said socket positioning the spark plug in said socket with its locking collar closely adjacent said shoulder, whereby lateral movement of the wrench relative to a spark plug therein can only produce forces against the spark plug adjacent the locking collar, the free reception of the spark plug insulator portion in the reduced diameter portion of said body member allowing the outer diameter of said body member to be of reduced size for fitting in small places in a vehicle engine.

2. A spark plug wrench for installing and removing spark plugs of the type having a hexagon base and a reduced diameter insulator portion secured to the base by a metal locking collar, comprising:

a tubular body member, said tubular body member having an interior hexagon socket end arranged to freely receive the hexagon base of a spark plug, an elongated groove in said hexagon socket end, a leaf spring secured at one of its ends in said groove arranged to engage a portion of the hexagon base of a spark plug for releasably holding the spark plug in the wrench, said one end of said spring being secured in said groove by upset metal portions of said groove forced over said spring end, an opening in said hexagon socket aligned with said one end of said spring for receiving a tool to provide the upsetting of said metal portions, said tubular body member having a body portion of reduced diameter relative to said hexagon socket end allowing the wrench to be worked in tight places, said body portion having an interior of sufficient size to receive a spark plug insulator portion with clearance therearound, said hexagon socket end and said reduced diameter tubular portion being dimensioned and arranged such that an interior junction therebetween is adjacent the locking collar of a spark plug which is mounted in the wrench, whereby lateral movement of the wrench relative to a spark plug therein can only reduce forces against the spark plug adjacent the locking collar.

* * * * *